US006799345B2

(12) United States Patent
Occhiolini et al.

(10) Patent No.: US 6,799,345 B2
(45) Date of Patent: Oct. 5, 2004

(54) FOOTBRIDGE SUPPORT

(76) Inventors: David Occhiolini, 432 Jackson Rd., Williamstown, NJ (US) 08094; Douglas Moore, 325 E. Collings Dr., Williamstown, NJ (US) 08094

( * ) Notice: Subject to any disclaimer, the term of this patent is extended or adjusted under 35 U.S.C. 154(b) by 0 days.

(21) Appl. No.: 10/336,971

(22) Filed: Jan. 2, 2003

(65) Prior Publication Data

US 2004/0151541 A1 Aug. 5, 2004

(51) Int. Cl.[7] ..... E01D 6/02
(52) U.S. Cl. ..... 14/12
(58) Field of Search ..... 14/2.4, 3, 4, 9, 14/12, 24, 73, 2

(56) References Cited

U.S. PATENT DOCUMENTS

| | | | | | |
|---|---|---|---|---|---|
| 25,210 | A | * | 8/1859 | Montgomery | 14/13 |
| 110,173 | A | * | 12/1870 | Turley | 14/3 |
| RE8,959 | E | * | 11/1879 | Long | 14/9 |
| 374,271 | A | * | 12/1887 | Rodemer | 52/694 |
| 542,531 | A | * | 7/1895 | Ogle | 14/9 |
| 2,284,022 | A | * | 5/1942 | Schmeller, Sr. | 14/69.5 |
| 3,406,616 | A | * | 10/1968 | McLean | 404/1 |
| 3,768,108 | A | * | 10/1973 | Wadsworth | 14/24 |
| 3,872,532 | A | * | 3/1975 | Cornelius et al. | 14/3 |
| 4,700,516 | A | * | 10/1987 | Grossman | 52/223.1 |
| 5,042,101 | A | * | 8/1991 | Huether | 14/2.4 |
| 6,108,998 | A | * | 8/2000 | Dumlao | 52/783.17 |

* cited by examiner

*Primary Examiner*—Robert E. Pezzuto
*Assistant Examiner*—Raymond W. Addie
(74) *Attorney, Agent, or Firm*—Stuart M. Goldstein

(57) ABSTRACT

A footbridge support is provided which is constructed of aluminum or other lightweight, weather resistant metal frame of bow truss design. Specifically, the footbridge support consists of dual bow truss frames, each supporting opposite side regions of the footbridge. The top rail of the truss frames is of curved configuration, with a given radius of curvature corresponding to the radius of curvature of the footbridge. The footbridge support also includes bottom members and transverse cross-members which connect the dual truss frames. A medial support member is positioned on the longitudinal midline of the footbridge and also corresponds to the radius of curvature of the footbridge to support the medial section of the footbridge. Decking is provided across the footbridge support, running from one of the dual truss frames to the other frame. With this footbridge support, longer and wider footbridges can be constructed with increased weight limits.

21 Claims, 3 Drawing Sheets

FOOTBRIDGE SUPPORT

BACKGROUND OF THE INVENTION

Simple footbridge structures are routinely used to allow ready access by pedestrians over ponds, creeks, streams, and small ravines, or other relatively narrow impediments which must be traversed. Footbridges which are used in gardens or landscaped areas for decorative purposes, also often must be able to accommodate pedestrian traffic.

Currently designed and produced footbridges which are curved in configuration, by their design, usually have relatively weak structural support and thus have severe weight and length limitations. Other footbridge designs most often use some arrangement of vertically positioned wood frame supports, usually constructed from a multitude of individual frame pieces which must be laboriously assembled. Even after assembly, such designs are not very sturdy and also are restricted by weight limitations and, by their nature, use, and cost, are also limited as to length. These footbridge structures often will not last over time, when subjected to the wide range of weather conditions which are encountered.

SUMMARY OF THE INVENTION

It is thus the object of the present invention to overcome the disadvantages and limitations of existing footbridge supporting structures.

It is an object of the present invention to provide a footbridge support which is sturdy and durable, in accommodating pedestrian and lightweight vehicle traffic.

It is a further object of the present invention to provide a footbridge support which comprises relatively few components and is thus easily assembled on site.

It is still another object of the present invention to provide a footbridge support which is durable and long lasting and can withstand all weather conditions which may be encountered during the life of the footbridge.

It is still a further object of the present invention to provide a footbridge support which is adaptable for supporting footbridges of various widths and lengths.

It is another object of the present invention to provide a footbridge support which will support longer and wider footbridges than currently available support systems.

It is still another object of the present invention to provide a footbridge support which is constructed of aluminum, such that it is relatively lightweight and durable.

This and other objects are accomplished by the footbridge support of the present invention which comprises an aluminum or other lightweight, weather resistant metal frame of bow truss design. Specifically, the footbridge support consists of dual bow truss frames, each supporting opposite side regions of the footbridge. The top rail of the truss frames is of curved configuration, with a given radius of curvature corresponding to the radius of curvature of the footbridge. The footbridge support also includes bottom members and transverse cross-members which connect the dual truss frames. A medial support member is positioned on the longitudinal midline of the footbridge and also corresponds to the radius of curvature of the footbridge to support the medial section of the footbridge. Decking is provided across the footbridge support, running from one of the dual truss frames to the other frame. With this footbridge support, longer and wider footbridges can be constructed with increased weight limits.

The novel features which are considered as characteristic of the invention are set forth in particular in the appended claims. The footbridge support itself however, both as to its design, construction, and use, together with additional features and advantages thereof, are best understood upon review of the following detailed description with reference to the accompanying drawings.

DETAILED DESCRIPTION OF THE DRAWINGS

DETAILED DESCRIPTION OF THE INVENTION

Figure 1:
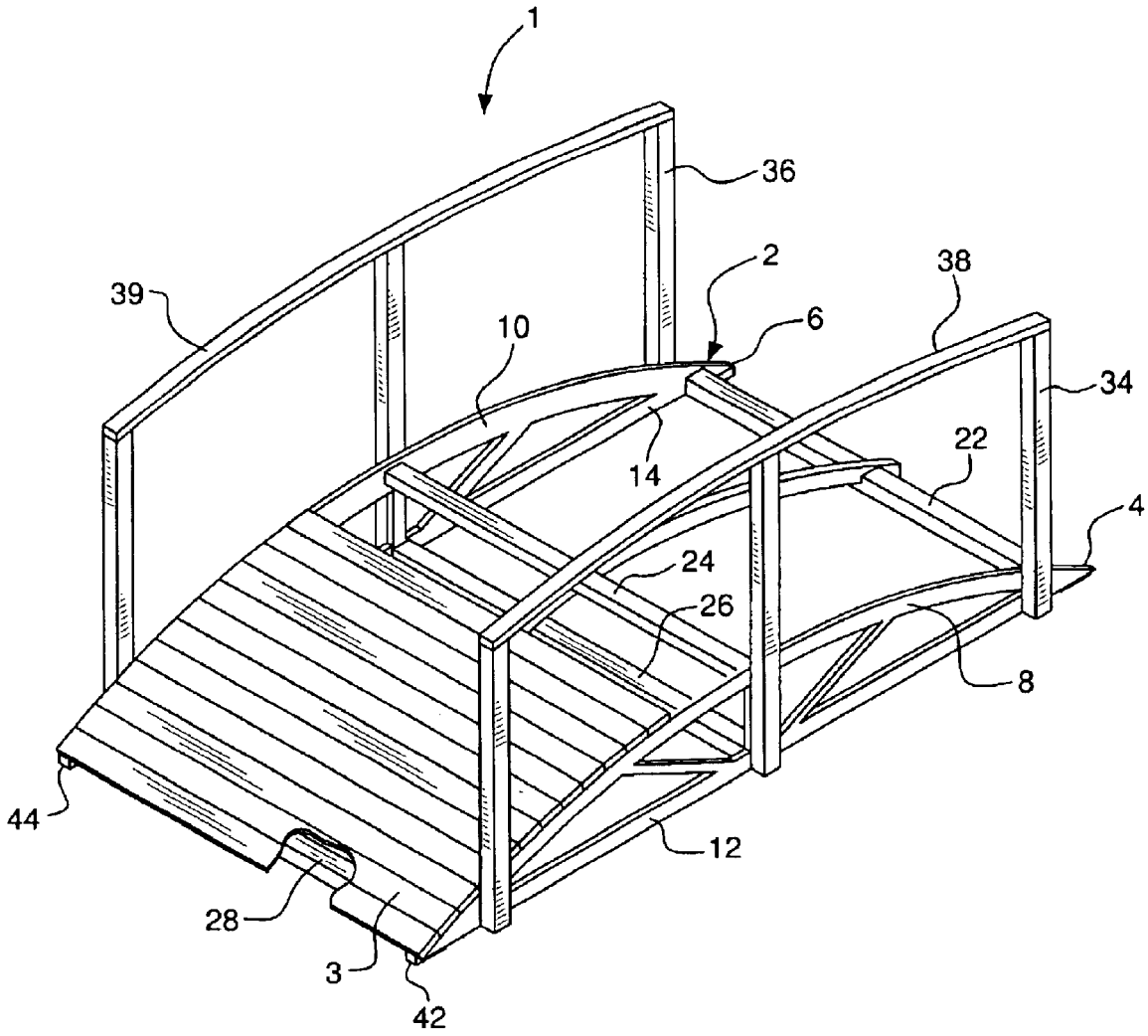
FIG. 1 shows a partially cut-away, isometric view of the support frame of the present invention.
Figure 2:
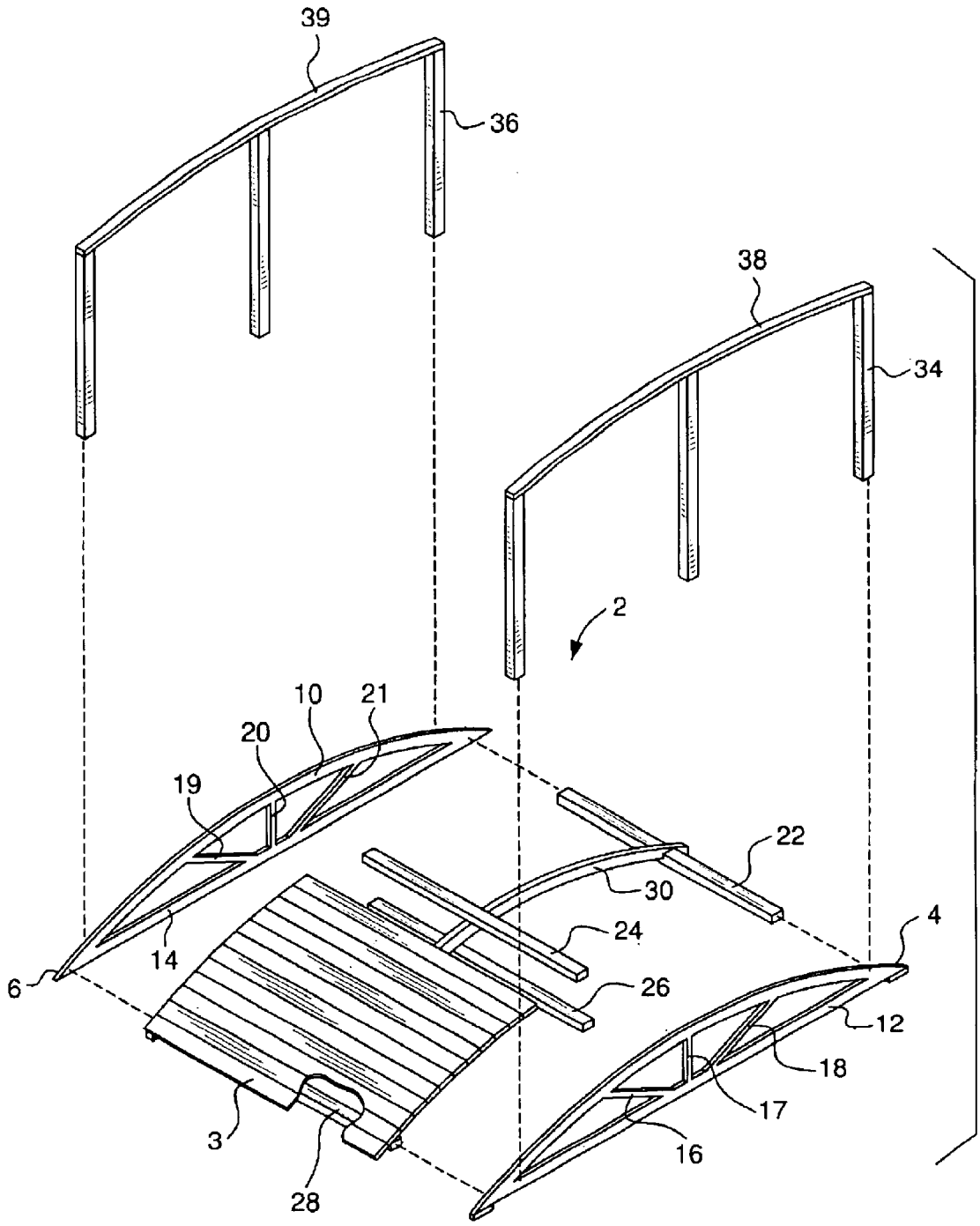
FIG. 2 shows an exploded, partially cut-away, isometric view of the support frame of the present invention.
Figure 3:
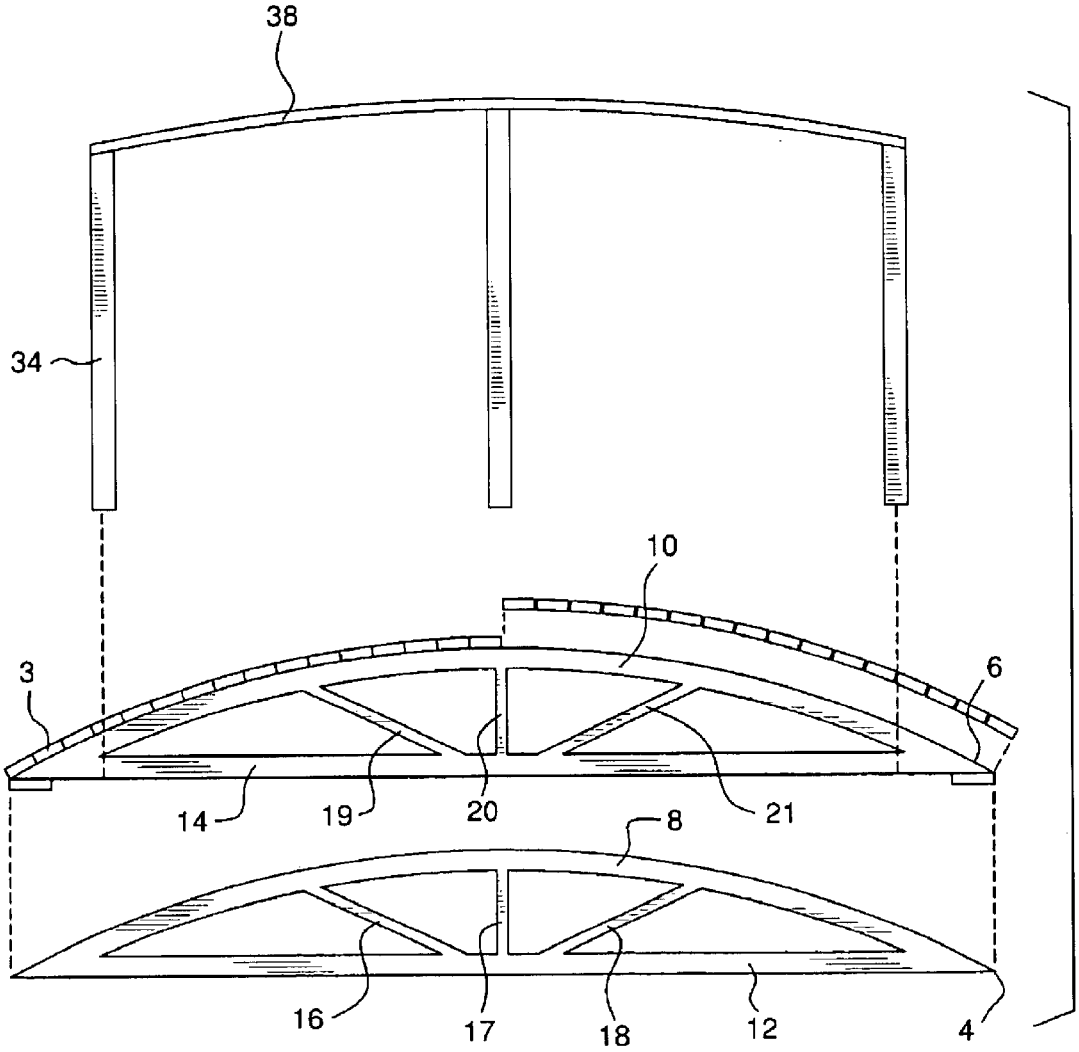
FIG. 3 shows an exploded side view of the support frame of the present invention.

Support frame 2 is used to support longitudinally extending footbridge 1 of a given radius of curvature. Footbridge 1 comprises decking 3 running between dual truss frames 4 and 6 which support and bear the weight of the side regions of the footbridge. Truss frames 4 and 6 each comprise upper rail members 8 and 10 respectively, which are of a radius of curvature corresponding to the radius of curvature of footbridge 1. Bottom members 12 and 14 are connected to upper rail members 8 and 10 respectively. Spar members 16, 17, and 18 connected to truss frame 4, and 19, 20 and 21 connected to truss frame 6, provide interconnecting support between upper rail member 8 and bottom member 12 and upper rail member 10 and bottom member 14.

Transverse cross members 22, 24, 26 and 28 are provided for transverse interconnecting support to truss frames 4 and 6. It is contemplated that cross members 22, 24, 26 and 28 will be bolted to tabs which are welded to truss frames 4 and 6. Other like attachment means may be used and the invention should not be considered restricted by the attachment means.

Center support member 30 can be a single piece or two separate pieces bolted together to cradle cross member 24. Member 30 runs the longitudinal length of footbridge 1, at its midline, and provides support to the medial region of the footbridge. The upper surface of member 30 may be straight or be of curved configuration, corresponding to the radius of curvature of footbridge 1. It is contemplated that member 30 will be bolted, or similarly attached to the underside of footbridge docking 3.

It is optimally contemplated that the truss components of the support frame of the invention will be made of aluminum, a lightweight, yet strong and durable material. Center support member 30 is optimally made of cedar, for flexibility and support. Decking 3 may be comprised of cedar or cypress boards, extending across the support between dual truss frames 4 and 6. Railing posts 34 and 36 can be attached to the outside of frame 2, with rails 38 and 39 connecting the posts. Optional footpads 42 and 44 can be bolted or otherwise secured to one or both ends of frame 2, to elevate the footbridge, as needed or desired to accommodate the adjacent area.

With this frame design of the invention, a curved footbridge is provided with significantly additional strength than prior structures. For example, the footbridge with the support frame of this invention has a line rating of at least 60 pounds per square foot, which no other prior footbridge has. The footbridge with the support of this invention can also be designed to extend over eighteen feet in length, well beyond the length of existing footbridges.

It is contemplated that the footbridge and support of this invention will be shipped with major components, such as truss frames 4 and 6, assembled, so that the entire footbridge can be assembled on site.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A support for a longitudinally extending curvilinear footbridge with a given radius of curvature comprising:

a. first weight bearing means located at the outermost sides of the footbridge for longitudinally supporting side regions of the footbridge, said first weight bearing means extending substantially the length of the footbridge and being longitudinally curvilinear in configuration with a radius of curvature corresponding to the radius of curvature of the footbridge;

b. second weight bearing means for longitudinally supporting the medial region of he footbridge, said second weight bearing means extending substantially the length of the footbridge and being longitudinally curvilinear in configuration with a radius of curvature corresponding to the radius of curvature of the footbridge;

c. beam means providing transverse, interconnecting support for the first weight bearing means, said beam means extending substantially the width of the footbridge; and d. a decking surface supported by and substantially overlaying the first weight bearing means, the second weight bearing means, and the beam means, said decking surface extending substantially the width of the footbridge and having a radius of curvature corresponding to the radius of curvature of the first and second weight bearing means.

2. The support as in claim 1 wherein the first weight bearing means comprises al truss frames having a radius of curvature corresponding to the radius of curvature of the footbridge.

3. The support as in claim 2 wherein each truss frame comprises bottom members connected to the upper rail members.

4. The support as in claim 3 further comprising spar members interconnected between the upper rail members and the bottom members.

5. The support as in claim 1 wherein the first weight bearing means comprises upper rail members, each rail member having a radius of curvature corresponding to the radius of curvature of the footbridge.

6. The support as in claim 5 wherein the first weight bearing means comprises bottom members connected to the upper rail members.

7. The support as in claim 6 further comprising spar members interconnected between the upper rail members and the bottom members.

8. The support as in claim 1 wherein the beam means comprises a plurality of transversely extending cross members.

9. The support as in claim 1 wherein the first weight bearing means comprises dual truss frames and the beam means interconnect the truss frames.

10. The support as in claim 9 wherein the beam means comprise a plurality of transversely extending cross members.

11. The support as in claim 9 wherein the truss frames comprise upper rail members, each rail member having a radius of curvature corresponding to the radius of curvature of the footbridge.

12. The support as in claim 1 wherein the second weight bearing means comprises a medial support member positioned substantially on the longitudinal midline of the footbridge.

13. The support as in claim 1 wherein the decking surface of the footbridge is of curved configuration with a radius of curvature corresponding to the radius of curvature of the footbridge.

14. The support as in claim 13 wherein the first weight bearing means comprises upper rail members, each rail member having a radius of curvature corresponding to the radius of curvature of the footbridge.

15. The support as in claim 14 wherein the beam means comprises a plurality of transversely extending cross members.

16. The support as in claim 15 wherein the second weight bearing means comprises a medial support member positioned substantially on the longitudinal midline of the footbridge.

17. A support for a longitudinally extending curvilinear footbridge of curved configuration having a given radius of curvature, said support comprising:

a. dual truss frames comprising upper rail members located at the outermost sides of the footbridge, each rail member extending substantially the length of the footbridge and being longitudinally curvilinear in configuration with a radius of curvature corresponding to the radius of the curvature of the footbridge;

b. a plurality of cross members located within different transverse planes, the cross members providing transverse, interconnecting support for the dual truss frames and extending substantially the width of the footbridge;

c. weight bearing means for longitudinally supporting the medial region of the footbridge, said weight bearing means extending substantially the length of the footbridge and being longitudinally curvilinear in configuration with a radius of curvature corresponding to the radius of curvature of the footbridge; and d. a deck surface overlaying and supported by the dual truss frames, the plurality of cross members, and the weight bearing means, said deck surface extending substantially the width of the footbridge.

18. The support as in claim 17 wherein one of the two dual truss frames is positioned to longitudinally support one side region of the footbridge and the other dual truss frame is positioned to support the opposite side region of the footbridge.

19. The support as in claim 17 further comprising bottom members connected to the upper rail members of the truss frames.

20. The support as in claim 19 further comprising spar supporting members interconnected between the upper rail members and the bottom members.

21. The support as in claim 17 wherein the weight bearing means comprises a medial support member positioned substantially on the longitudinal midline of the footbridge.

* * * * *